US009406181B2

(12) United States Patent
Almomani et al.

(10) Patent No.: US 9,406,181 B2
(45) Date of Patent: Aug. 2, 2016

(54) ELECTRONIC LOCK HAVING SOFTWARE BASED AUTOMATIC MULTI-WIRELESS PROFILE DETECTION AND SETTING

(71) Applicant: KWIKSET CORPORATION, Lake Forest, CA (US)

(72) Inventors: Nedal Akram Almomani, Mission Viejo, CA (US); Michael Maridakis, Garden Grove, CA (US)

(73) Assignee: Kwikset Corporation, Lake Forest, CA (US)

( * ) Notice: Subject to any disclaimer, the term of this patent is extended or adjusted under 35 U.S.C. 154(b) by 170 days.

(21) Appl. No.: 14/059,652

(22) Filed: Oct. 22, 2013

(65) Prior Publication Data

US 2014/0109634 A1 Apr. 24, 2014

Related U.S. Application Data

(60) Provisional application No. 61/717,154, filed on Oct. 23, 2012.

(51) Int. Cl.

| | |
|---|---|
| ***E05B 47/00*** | (2006.01) |
| ***G07C 9/00*** | (2006.01) |
| *E05B 27/00* | (2006.01) |

(52) U.S. Cl.

CPC ..... *G07C 9/00309* (2013.01); *E05B 47/0001* (2013.01); *G07C 9/00817* (2013.01); *E05B 27/00* (2013.01); *E05B 47/00* (2013.01); *G07C 9/00174* (2013.01); *G07C 2009/00769* (2013.01); *Y10T 70/7113* (2015.04)

(58) Field of Classification Search

USPC ..... 340/5.23

See application file for complete search history.

(56) References Cited

U.S. PATENT DOCUMENTS

| | | | | |
|---|---|---|---|---|
| 4,783,638 | A | 11/1988 | Mamodaly | |
| 5,729,057 | A | 3/1998 | Frenzel | |
| 5,739,766 | A * | 4/1998 | Chaloux | 340/10.41 |
| 5,841,390 | A | 11/1998 | Tsui | |

(Continued)

FOREIGN PATENT DOCUMENTS

| | | |
|---|---|---|
| EP | 0 753 822 A2 | 1/1997 |
| EP | 1 835 436 A2 | 9/2007 |

(Continued)

OTHER PUBLICATIONS

International Search Report; Patent Cooperation Treaty; Feb. 6, 2014.

(Continued)

*Primary Examiner* — Travis Hunnings
*Assistant Examiner* — Benyam Haile
(74) *Attorney, Agent, or Firm* — Barnes & Thornburg LLP

(57) ABSTRACT

An electronic lock that is self-configurable to automatically set a wireless communication protocol profile, or configuration, to allow the electronic lock to communicatively join the system in which the electronic lock is to be incorporated. In some embodiments, the electronic lock is programmed to execute in sequence a plurality of wireless protocol profiles stored in memory until a wireless protocol profile establishes wireless communications with another wireless communication device. Once this happens, the wireless protocol profile that was able to establish wireless communications is set as the default wireless protocol profile.

6 Claims, 7 Drawing Sheets

(56) References Cited

U.S. PATENT DOCUMENTS

| | | | | |
|---|---|---|---|---|
| 6,038,895 | A | 3/2000 | Menke | |
| 6,209,367 | B1 * | 4/2001 | Hyatt, Jr. | E05B 47/0002 70/278.1 |
| 6,370,381 | B1 * | 4/2002 | Minnick et al. | 455/445 |
| 6,906,612 | B2 | 6/2005 | Ghabra | |
| 6,937,140 | B1 | 8/2005 | Outslay et al. | |
| 6,967,562 | B2 | 11/2005 | Menard et al. | |
| 2003/0137404 | A1 | 7/2003 | Bonneau et al. | |
| 2003/0151493 | A1 | 8/2003 | Straumann et al. | |
| 2006/0255909 | A1 | 11/2006 | Pavatich | |
| 2007/0290792 | A1 | 12/2007 | Tsuchimochi | |
| 2008/0011032 | A1 | 1/2008 | Groff | |
| 2009/0256677 | A1 | 10/2009 | Hein | |
| 2010/0283579 | A1 | 11/2010 | Kraus et al. | |
| 2011/0234377 | A1 | 9/2011 | Landuyt et al. | |
| 2012/0073338 | A1 | 3/2012 | Mohla | |
| 2012/0157080 | A1 | 6/2012 | Metivier | |
| 2012/0196588 | A1 * | 8/2012 | Shah | 455/419 |
| 2012/0213362 | A1 | 8/2012 | Bliding et al. | |
| 2013/0295986 | A1 * | 11/2013 | Mueck | 455/552.1 |
| 2013/0342314 | A1 | 12/2013 | Chen et al. | |
| 2014/0028438 | A1 | 1/2014 | Kuenzi et al. | |

FOREIGN PATENT DOCUMENTS

| | | | |
|---|---|---|---|
| EP | 1835436 | A2 * | 9/2007 |
| WO | WO 00/65551 | A1 | 11/2000 |
| WO | WO 2009/088901 | A1 | 7/2009 |
| WO | WO2009/158181 | | 12/2009 |
| WO | WO 2010/012463 | A2 | 2/2010 |
| WO | WO 2011/109005 | A1 | 9/2011 |

OTHER PUBLICATIONS

USPTO; Office Action; U.S. Appl. No. 14/059,625; Aug. 27, 2015.

International Search Report; Patent Cooperation Treaty; Feb. 19, 2014; PCT/US2013/66816.

International Search Report; Patent Cooperation Treaty; Apr. 10, 2014; PCT/US2013/74291.

* cited by examiner

ELECTRONIC LOCK HAVING SOFTWARE BASED AUTOMATIC MULTI-WIRELESS PROFILE DETECTION AND SETTING

RELATED APPLICATIONS

The present application is related to and claims priority to U.S. Provisional Patent Application, Ser. No. 61/717,154, filed on Oct. 23, 2012, entitled "Electronic Lock Having Software Based Automatic Multi-Wireless Profile Detection and Setting." The subject matter disclosed in that provisional application is hereby expressly incorporated into the present application in its entirety.

TECHNICAL FIELD

The present invention relates generally to electronic locks, and, more particularly, to an electronic lock having software based multi-wireless profile detection and setting.

BACKGROUND AND SUMMARY

Electronic locks are commercially available having a capability of communicating via using a standardized short range wireless radio frequency (r.f.) communication protocol, such as for example, the Zigbee and Z-Wave wireless communications protocols. Lock and systems developers often customize their respective commercial offerings to include customer specific communication hardware and methods that utilize variations of standard protocols. As such, each electronic lock hardware unit has to be customized to support a particular customer's system communications configuration of a plurality of potential customer configurations. Thus, a manufacturer of electronic locks must have on-hand separate electronic lock hardware units, i.e., stock keeping units (SKUs), which satisfy the communications requirements of each of its customers, thus adding cost and complexity in the entire supply chain in addition to potentially adding confusion in the distribution channel for the distributors and dealers who deal with these variations.

What is needed in the art is an electronic lock having software based multi-wireless profile detection and setting, wherein an electronic lock is self-configurable to automatically set a wireless communication protocol profile, or configuration, to allow the electronic lock to communicatively join the system in which the electronic lock is to be incorporated.

According to one aspect, the invention provides an electronic lock with a latch assembly having a bolt movable between an extended position and a retracted position and a circuit configured to control the bolt. A wireless module is provided to wirelessly communicate with other electronic communication devices in range of the lock. A non-transitory computer-readable medium is provided that has a plurality of wireless protocol profiles and a computer program code stored thereon. The lock includes a processor in communication with the computer-readable memory configured to carry out instructions in accordance with the computer program code. In one embodiment, the processor is programmed to determine whether a default wireless protocol profile has been established. If not, the processor executes in sequence the plurality of wireless protocol profiles stored in the computer-readable medium until a wireless protocol profile establishes wireless communications with another wireless communication device. Once this happens, the wireless protocol profile that was able to establish wireless communications is set as the default wireless protocol profile. In some cases, the processor determines whether the default wireless protocol profile has been established during power-up of the electronic lock, such as by checking if a profile flag has been set. In some embodiments, the electronic lock includes an interface configured to store one or more additional wireless protocol profiles to the computer-readable memory. This could be done through either a wired or wireless connection with the lock.

According to another aspect, the invention provides an electronic lock with a latch assembly including a bolt movable between an extended position and a retracted position. A circuit is provided that includes a processor unit, a memory unit, and a wireless module. The circuit is configured to control movement of the bolt between the extended and retracted positions. The circuit also automatically determines an appropriate wireless protocol by sequentially executing a plurality of wireless protocol profiles stored in the memory unit until the circuit establishes wireless communications with another wireless communication device. Typically, the circuit sets the wireless protocol profile that was able to establish wireless communications as a default wireless protocol profile. Upon power up, the processor will then automatically load the default wireless protocol profile.

According to a further aspect, the invention provides an electronic lock with a latch assembly including a bolt movable between an extended position and a retracted position. The lock includes means for electronically controlling the latch assembly. Additionally, means are provided for automatically determining an appropriate wireless protocol for the electronic lock by sequentially executing a plurality of wireless protocol profiles until wireless communications is established with another wireless communication device.

Additional features and advantages of the invention will become apparent to those skilled in the art upon consideration of the following detailed description of the illustrated embodiment exemplifying the best mode of carrying out the invention as presently perceived.

BRIEF DESCRIPTION OF DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION OF THE DRAWINGS

Figure 1A:
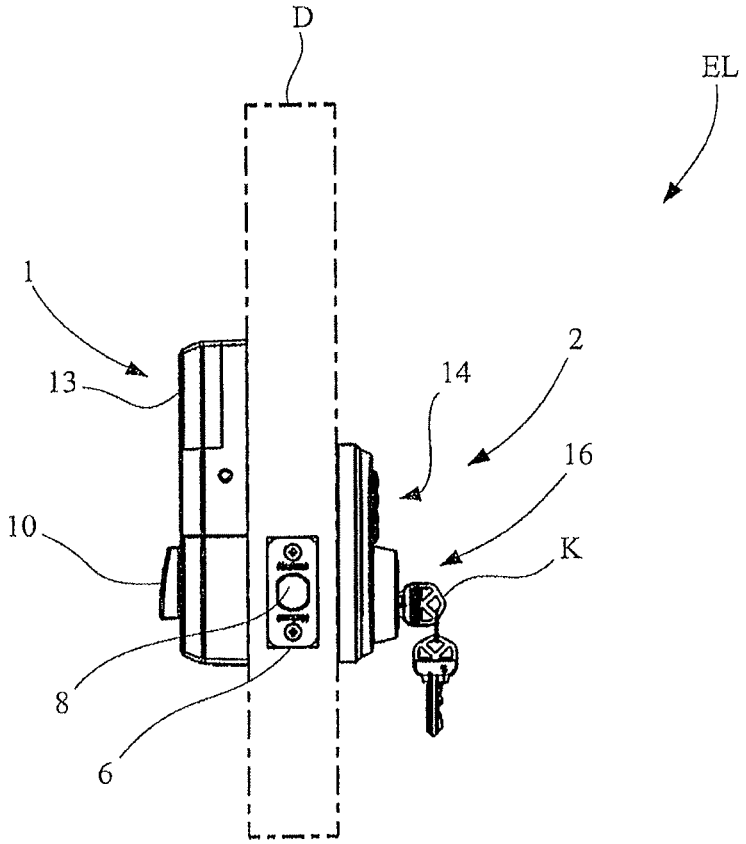
FIG. 1A is a side view of an electronic lock in accordance with an embodiment of the present invention, installed on a door and with the door shown in phantom lines.
Figure 1B:
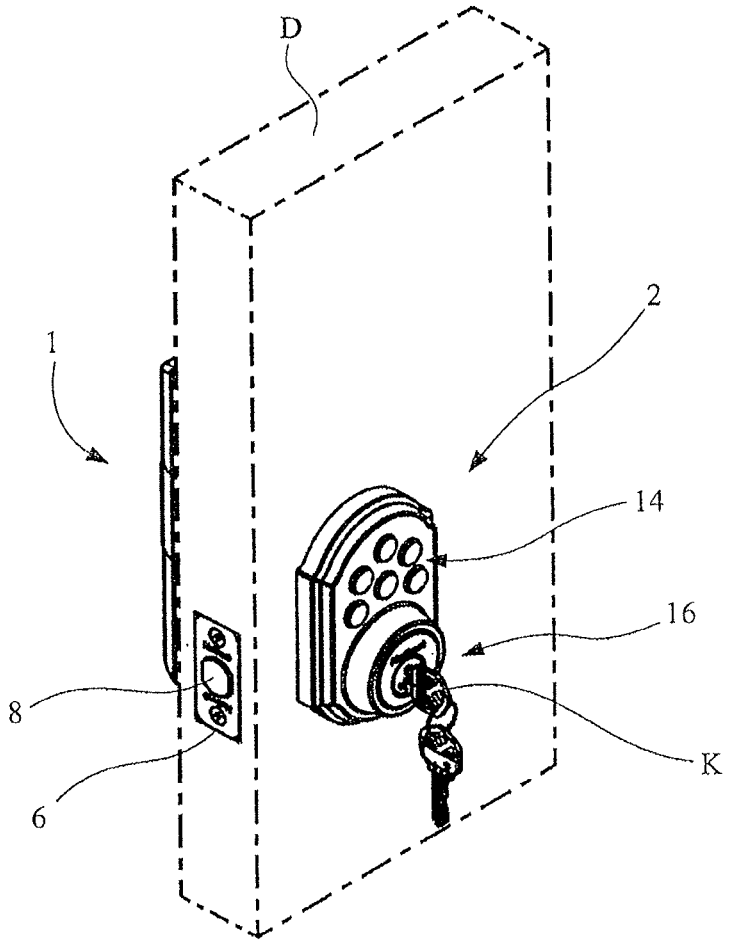
FIG. 1B is a perspective view of the electronic lock of FIG. 1A, as viewed from the exterior of the door.
Figure 1C:
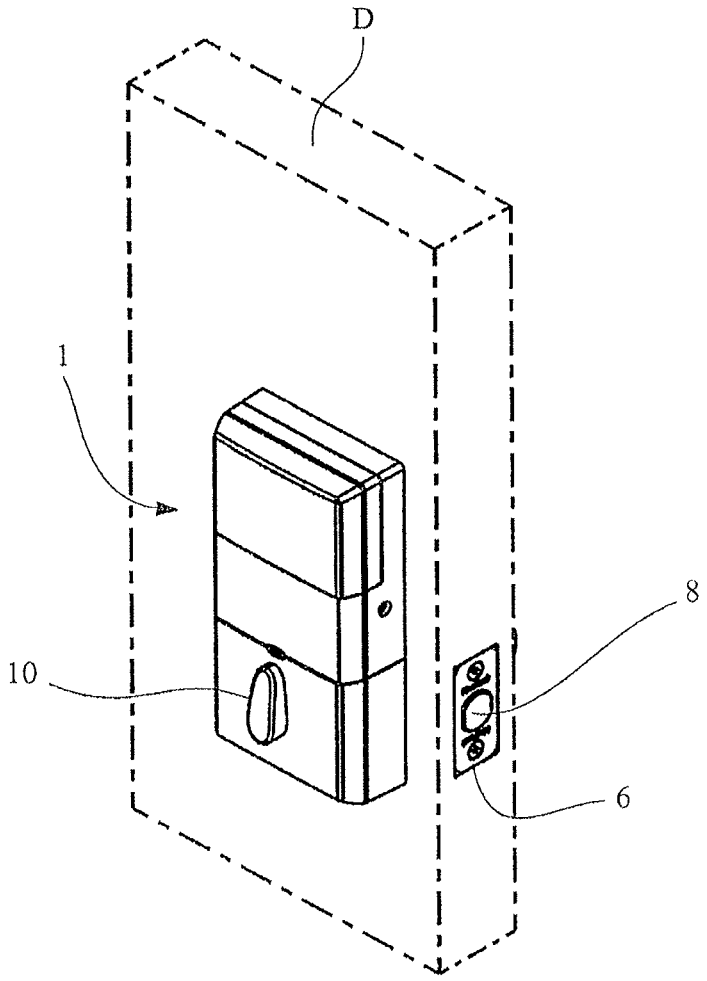
FIG. 1C is a perspective view of the electronic lock of FIG. 1A as viewed from the interior of the door.

Referring now to the drawings and particularly to FIGS. 1A-1C and 2, there is shown an electronic lock (EL) in accordance with an embodiment of the present invention for mounting on a door D, and which includes an interior chassis 1, an exterior chassis 2, a mounting plate 3, an adapter 4, a latch assembly 5, and a strike 6.

Figure 2:
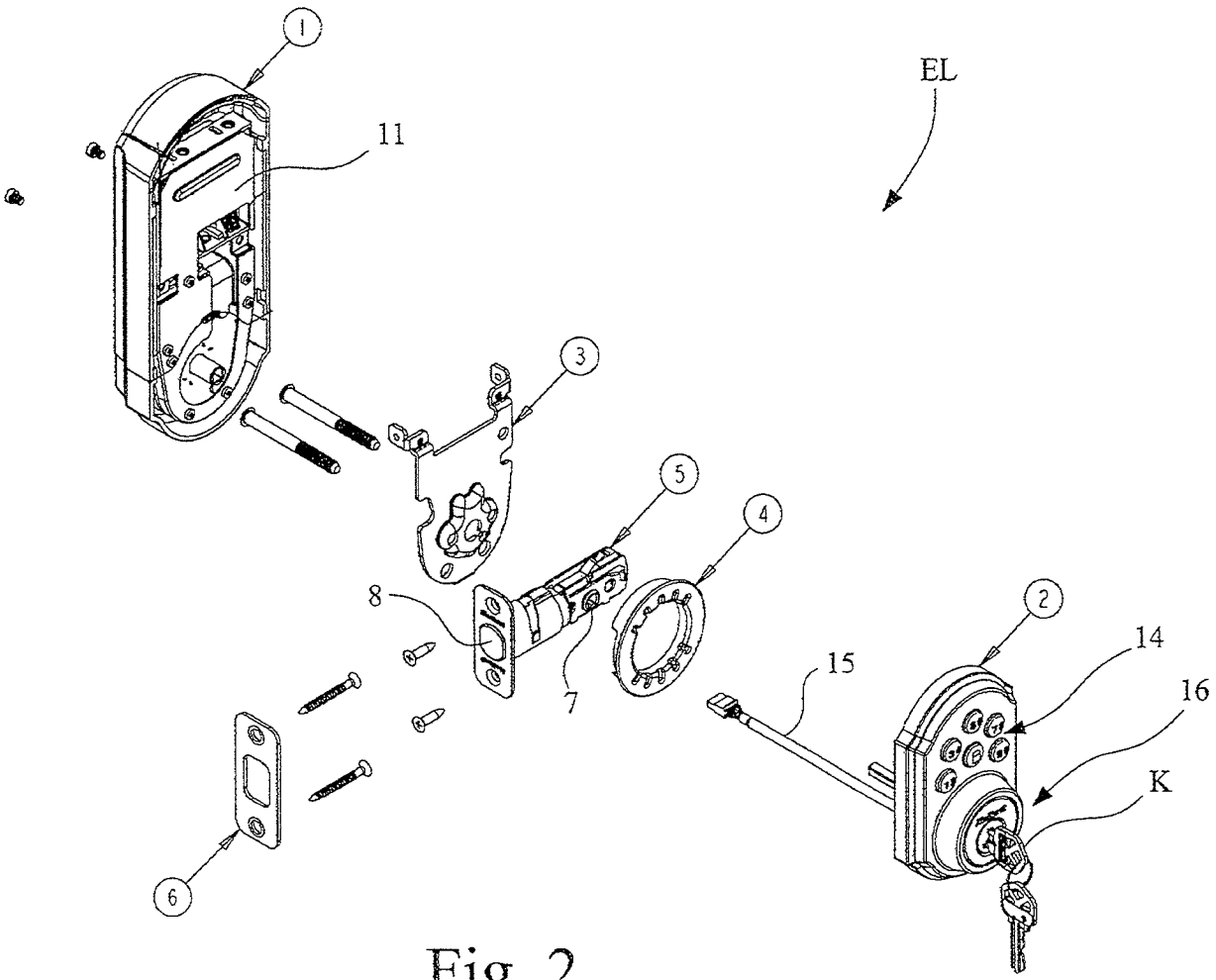
FIG. 2 is an exploded view of the electronic lock of FIGS. 1A-1C.

As shown in FIG. 2, latch assembly 5 is of a configuration well known in the art, and includes a bolt actuator mechanism 7, and a bolt 8. Mounting plate 3 is used to mount the electronic lock to the door D. Adapter 4 is used to adapt the electronic lock to a particular hole opening in the door D.

Figure 3:
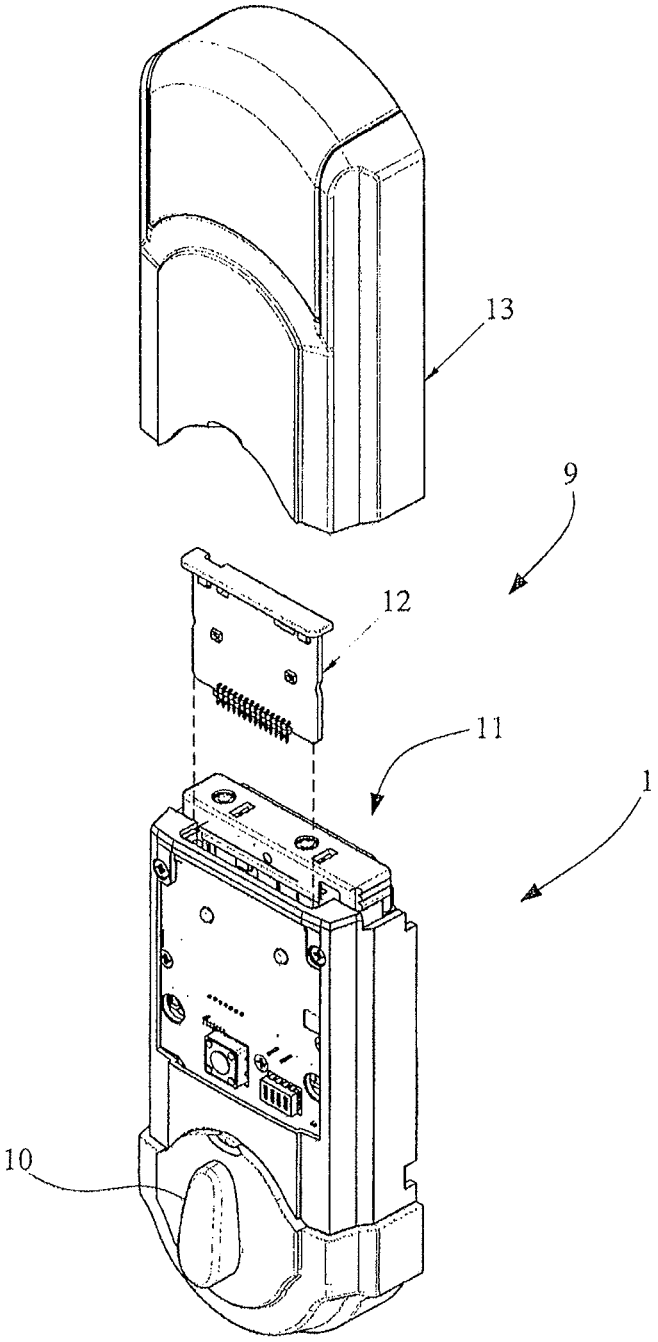
FIG. 3 is a perspective view of the interior chassis of the electronic lock of FIG. 2, with the upper cover and daughter card removed.

Referring also to FIG. 3, interior chassis 1 includes the electronics circuitry 9 for the electronic lock, and further includes a manual turnpiece 10. Manual turnpiece 10 is used on the interior side of door D to operate the bolt actuator mechanism 7 of latch assembly 5, and in turn to extend and retract bolt 8 (see also FIG. 1C). In one embodiment, the electronics circuitry 9 includes a base board 11 and a removable daughter card 12. Depending on the circumstances, the electronics circuitry 9 could be implemented entirely on the base board 11. In FIG. 3, a removable cover 13 is provided to cover over the base board 11 and daughter card 12, when cover 13 is in the installed position. Daughter card 12 is a wireless communications module that facilitates wireless communications with an external device though a desired wireless communications protocol, e.g., Zigbee, Z-wave, etc.

Referring again to FIG. 2, exterior chassis 2 includes a keypad 14 for receiving a user input. Keypad 14 is electrically connected to the base board 11 of electronics circuitry 9, such as for example by an electrical cable 15. When the user inputs a valid code via keypad 14 that is recognized by the electronics circuitry 9, an electrical motor (not show) is energized to retract the bolt 8 of latch assembly 5, thus permitting door D (see FIG. 1B) to be opened from a closed position. Alternatively, a key actuator 16, having a removable key K, is provided for manually operating latch assembly 5 from the exterior of the door D.

Figure 4:
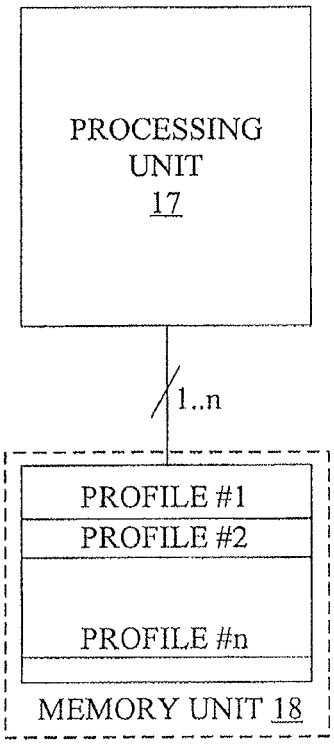
FIG. 4 is a block diagram of a portion of the electronics circuitry of the interior chassis of FIG. 3, as it pertains to an embodiment of the present invention.

Referring particularly to FIG. 3 and FIG. 4, daughter card 12 is a wireless communications module that facilitates wireless communications with an external device through a desired wireless communications protocol, e.g., Zigbee, Z-wave, etc. In accordance with the present invention, base board 11 and/or daughter card 12 of electronics circuitry 9 is configurable to enable automatic selection of an appropriate wireless protocol profile, i.e., a configuration corresponding to a standard wireless protocol or a desired variation of the standard wireless protocol, so as to allow the electronic lock to communicatively join a system into which the electronic lock is being incorporated.

Electronics circuitry 9 may include, for example, an EMBER Corporation EM357 chip along with associated devices to handle all IEEE 802.15.4 operations. The chip and associated devices is driven by a 24.00 MHz crystal which is used to produce other internal clocks. Additional devices, such as LED's, switches, other integrated circuits, antenna and others are designed into electronics circuitry 9.

Referring to FIG. 4, electronics circuitry 9 includes a processing unit 17 and a memory unit 18.

Processing unit 17 includes a commercially available microprocessor or a custom built processing unit (ASIC=Application Specific Integrated Circuit) and associated input/output (I/O) circuitry, and is configured for electronic communication with memory unit 18. Processing unit 17 is configured such that during a system boot-up process (e.g., at power up) or a designated profile selection event, processing unit 17 automatically uses the appropriate wireless communication protocol profile from a plurality of wireless protocol profiles #1-#n stored in memory unit 18.

Memory unit 18 is an electronic semiconductor memory device, such as for example, a read only memory (ROM), erasable programmable read only memory (EPROM), electrically erasable programmable read only memory (EEPROM), embedded memory in the processing unit 17 etc. As shown in FIG. 4, memory unit 18 is configured to store a plurality of wireless protocol profiles #1-#n associated with a wireless communication protocol. Each wireless protocol profile stored in memory unit 18 corresponds to a standard wireless protocol or a specific variation of the standard wireless protocol as dictated by the wireless communications system requirements of a respective customer. For example, different implementations of wireless protocols could correspond with different wireless protocol profiles. By way of example, a first manufacturer's implementation of the Zigbee protocol could be a first profile and a second manufacturer's implementation of the Zigbee protocol could be a second profile. Alternatively, or in addition, it is contemplated that memory unit 18 may store a plurality of sets of wireless protocol profiles, with each set of wireless protocol profiles being associated with a respective wireless communication protocol. The wireless protocol profiles in memory unit 18 may be updated, or new wireless protocol profiles added, by a wired or wireless connection to electronics circuitry 9 from a profile source device, such as a computer.

In accordance with an embodiment of the present invention, if no wireless protocol profile was previously selected, on power-up, e.g., boot-up, processing unit 17 executes program instructions to sequentially and individually retrieve, load and execute in sequential order each of the wireless protocol profiles of the plurality of wireless protocol profiles #1-#n stored in memory unit 18 until wireless communication is established with another wireless communication device of the system into which the electronic lock is being integrated.

Figure 5:
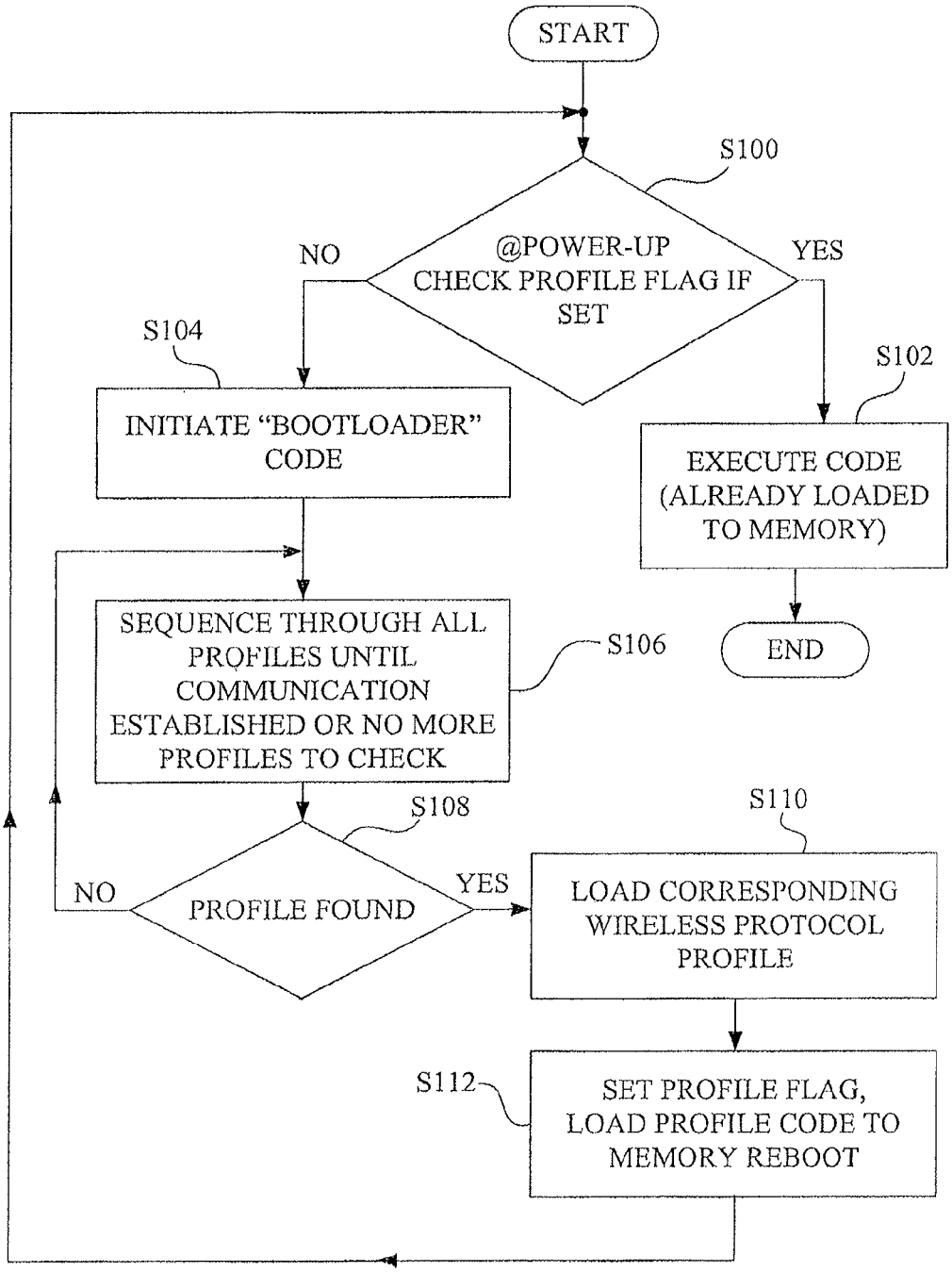
FIG. 5 is flowchart depicting a profile selection routine for automatically selecting a wireless protocol profile for use by the electronic lock, in accordance with an embodiment of the present invention.

FIG. 5 is an exemplary profile selection routine that may be used by electronics circuitry 9 of the electronic lock to automatically select the appropriate wireless communication protocol profile from the plurality of wireless protocol profiles stored in memory unit 18.

At step S100, upon power-up of the electronic lock, processing unit 17 checks to see if a profile flag is set. The profile flag is an indication as to whether an appropriate wireless protocol profile has been established as a default wireless protocol profile for the electronic lock.

If the result of step S100 is YES, then at step S102 the default wireless protocol profile is already loaded into the executable memory of processing unit 17, and the process ends.

If the result at step S100 is NO, then at step S104 the "bootloader code" is executed to initialize electronics circuitry 9 to automatically and sequentially scroll through the supported wireless communication protocol profiles stored in memory unit 18.

At step S106, processing unit 17 sequences through the wireless protocol profiles stored in memory unit 18 until communication is established, or until there are no more profiles to check.

For example, referring again also to FIG. 4, processing unit 17 retrieves a first profile, e.g., wireless protocol profile #1, from memory unit 18. Processing unit 17 then executes the selected wireless protocol profile to configure electronics circuitry 9 for attempted wireless communication with another communication device in the system in which the electronic lock is being installed.

If at step S106 no communication is detected, then at step S108 it is determined that no wireless protocol profile has been found and processing unit 17 will then re-execute step S106 and sequentially advance to the next profile, e.g., wireless protocol profile #2, and retrieve the next profile, e.g., wireless protocol profile #2, from memory unit 18. Processing unit 17 then executes the selected profile, e.g., wireless protocol profile #2, to configure electronics circuitry 9 for attempted communication with another communication device in the system in which the electronic lock is being installed. This process continues until the appropriate wireless protocol profile that facilitates wireless communication with another communication device in the system is established, thus becoming the default wireless protocol profile.

If all wireless protocol profiles #1-#n are tried with no wireless communications being established, then the electronic lock will indicate an error, e.g., by illuminating an error LED or by an audible sound or both. It could also be setup to repeat the loop until terminated by the users. As it starts a new loop, it provides an indication by illuminating an LED or by an audible sound or both (or using other user interface).

At step S106, if communications is established with another communication device in the system, then at step S108 it is determined that the appropriate wireless protocol profile has been found, and will be the default wireless protocol profile. The process proceeds to step S110.

At step S110, the identified default wireless protocol profile is stored in processor memory of processing unit 17 and loaded for default execution by processing unit 17.

At step S112, processing unit 17 sets the profile flag. From this time on, the electronics circuitry 9 will execute the same default wireless protocol profile.

The process returns to step S100, after which step S102 is again executed and the process ends.

Thus, in accordance with an embodiment of the present invention, once communication is established on a given wireless protocol profile, the wireless protocol profile or an executable program corresponding to the profile is uploaded into the target memory location, e.g., processor memory, of processing unit 17, for execution. From that point on, the electronic lock will power up with that default setting until certain criteria is met that requires desired protocol configuration verification. Such criteria may be, for example, a power loss or movement of the electronic lock to a new location and/or new system. An embodiment of the present invention thus enables automatic detection and selection of the desired wireless protocol profile.

Advantageously, an embodiment of the present invention allows the flexibility to add new wireless protocol profiles on the same electronic lock (EL) unit, i.e., stock keeping unit (SKU), to accommodate the various wireless protocol profile configuration requirements of multiple customers, without having to create new hardware specific to a particular customer, e.g., system provider. Also, an embodiment of the present invention provides flexibility during manufacturing of the electronic lock (EL) if and when a new custom wireless protocol profile is required by a customer.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. An electronic lock comprising:

a latch assembly including a bolt movable between an extended position and a retracted position;

a circuit including a processor unit, a memory unit, and a wireless module;

wherein the circuit is configured to control movement of the bolt between the extended and retracted positions;

wherein the circuit is configured to automatically determine an appropriate wireless protocol by sequentially executing a plurality of wireless protocol profiles stored in the memory unit until the circuit establishes wireless communications with another wireless communication device; and wherein the circuit is configured to set the wireless protocol profile that was able to establish wireless communications as a default wireless protocol profile, wherein the processor automatically loads the default wireless protocol if the circuit times out when attempting to establish a wireless communication with another wireless communication device.

2. The electronic lock as recited in claim 1, wherein the circuit is configured to add one or more additional wireless protocol profiles to the memory unit.

3. The electronic lock as recited in claim 2, wherein the circuit is configured to add one or more additional wireless protocol profiles to the memory unit via a wired connection with a profile source device.

4. The electronic lock as recited in claim 2, wherein the circuit is configured to add one or more additional wireless protocol profiles to the memory unit via a wireless connection with a profile source device.

5. The electronic lock as recited in claim 1, wherein the circuit is configured to update the plurality of wireless protocol profiles stored in the memory unit.

6. The electronic lock as recited in claim 1, wherein circuit is configured to set the wireless protocol profile that was able to establish wireless communications as a default wireless protocol profile.

* * * * *